United States Patent [19]

Uto et al.

[11] Patent Number: 5,021,837

[45] Date of Patent: Jun. 4, 1991

[54] APPARATUS DISCHARGED SHEET STACKING

[75] Inventors: Nobutaka Uto, Kanagawa; Masaaki Sato; Kimiaki Hayakawa, both of Yokohama; Takeshi Honjo, Kawasaki, all of Japan

[73] Assignee: Canon Kabushiki Kaisha, Tokyo, Japan

[21] Appl. No.: 440,677

[22] Filed: Nov. 24, 1989

[30] Foreign Application Priority Data

Nov. 26, 1988 [JP] Japan ..... 63-299922
Nov. 26, 1988 [JP] Japan ..... 63-299923

[51] Int. Cl.[5] ..... G03G 21/00

[52] U.S. Cl. ..... 355/322; 227/99; 270/53; 355/324

[58] Field of Search ..... 270/37, 53, 58; 355/321, 322, 324; 227/99

[56] References Cited

U.S. PATENT DOCUMENTS 4,061,331 12/1977 Habich ..... 271/217 X
4,329,046 5/1982 Burkett et al. ..... 355/321 X
4,350,333 9/1982 Landa ..... 271/217
4,424,963 1/1984 Bartholet et al. ..... 270/53
4,497,478 2/1985 Reschenhofer et al. ..... 355/324 X
4,605,211 8/1986 Sonobe ..... 270/58 X
4,775,139 10/1988 Honjo et al. ..... 271/10
4,878,656 11/1989 Honjo et al. ..... 270/53

FOREIGN PATENT DOCUMENTS 0289217 11/1988 European Pat. Off. ..... 270/37
2724345 12/1977 Fed. Rep. of Germany .
2126997 4/1984 United Kingdom .

*Primary Examiner*—Fred L. Braun
*Assistant Examiner*—William J. Royer
*Attorney, Agent, or Firm*—Fitzpatrick, Cella, Harper & Scinto

[57] ABSTRACT

A sheet post-processing apparatus includes stacking device for stacking sheet materials discharged; a processing device for processing the sheet materials stacked on the stacking device; a discharging device for discharging from the stacking device the sheet materials processed by the processing device when a processing mode is selected; an accommodating device, movable substantially vertically, for accommodating sheet materials discharged by the discharging device; a second discharging device for discharging, in the processing mode, the sheet materials so that the sheet materials are bridged between the stacking device and the accommodating device, and for discharging, in a non-processing mode, the sheet materials so that they are stacked on the accommodating device.

18 Claims, 10 Drawing Sheets

APPARATUS DISCHARGED SHEET STACKING

FIELD OF THE INVENTION AND RELATED ART

The present invention relates to a sheet finisher usable with an image forming apparatus such as a copying machine or a laser beam printer, and more particularly to a sheet finisher provided with a first finisher, which will be hereinafter called a "processing tray" which processes the sheets discharged from the image forming apparatus by stapling or punching the sheets, for example, and a second finisher which will hereinafter be called a "sheet accommodating tray".

A sheet finisher provided with a processing tray for finishing the sheets by stapling or punching them and also with a sheet accommodating tray, is known. However, in the known type of finishers, the sheets having images discharged from the image forming apparatus are stapled or punched in the processing tray, and then they are accommodated in the sheet accommodating tray.

However, the conventional sheet finishing apparatus includes processing tray and accommodating tray which are separately provided, with the result that the size of the apparatus becomes large. In order to solve this problem, U.S. Pat. No. 4,424,963 proposes a sheet finisher. However, in the sheet finisher, a tray for accommodating the sheets having been subjected to the finishing operation and the tray for accommodating the sheets not having been subjected to the finishing operation are separately provided, and therefore, the problem of the bulkiness of the apparatus is not solved.

SUMMARY OF THE INVENTION

Accordingly, it is a principal object of the present invention to provide a sheet finisher, the size of which can be minimized, and to provide an image forming apparatus equipped with the sheet finisher.

According to an aspect of the present invention, there is provided a sheet finisher which has a common tray for accommodating the sheets having been subjected to a finishing operation and for accommodating the sheets not having been subjected to a finishing operation.

In an embodiment of the present invention, there is provided a sheet finisher having a processing tray and a sheet accommodating tray, wherein during the processing mode, the sheets are accommodated bridging between the processing tray and the sheet accommodating tray, whereas during the non-processing mode, the sheets are accommodated in the sheet accommodating tray. This is accomplished by sheet discharging means for discharging the sheets.

According to the present invention, the size of the apparatus can be reduced since the tray is used commonly for the two purposes.

Particularly, the present invention is effective by using a discharge sheet stacker tray wherein plural trays are vertically movable to accommodate a number of sheet materials.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 5 comprises FIGS. 5A and 5B.

DESCRIPTION OF THE PREFERRED EMBODIMENTS

Figure 1:
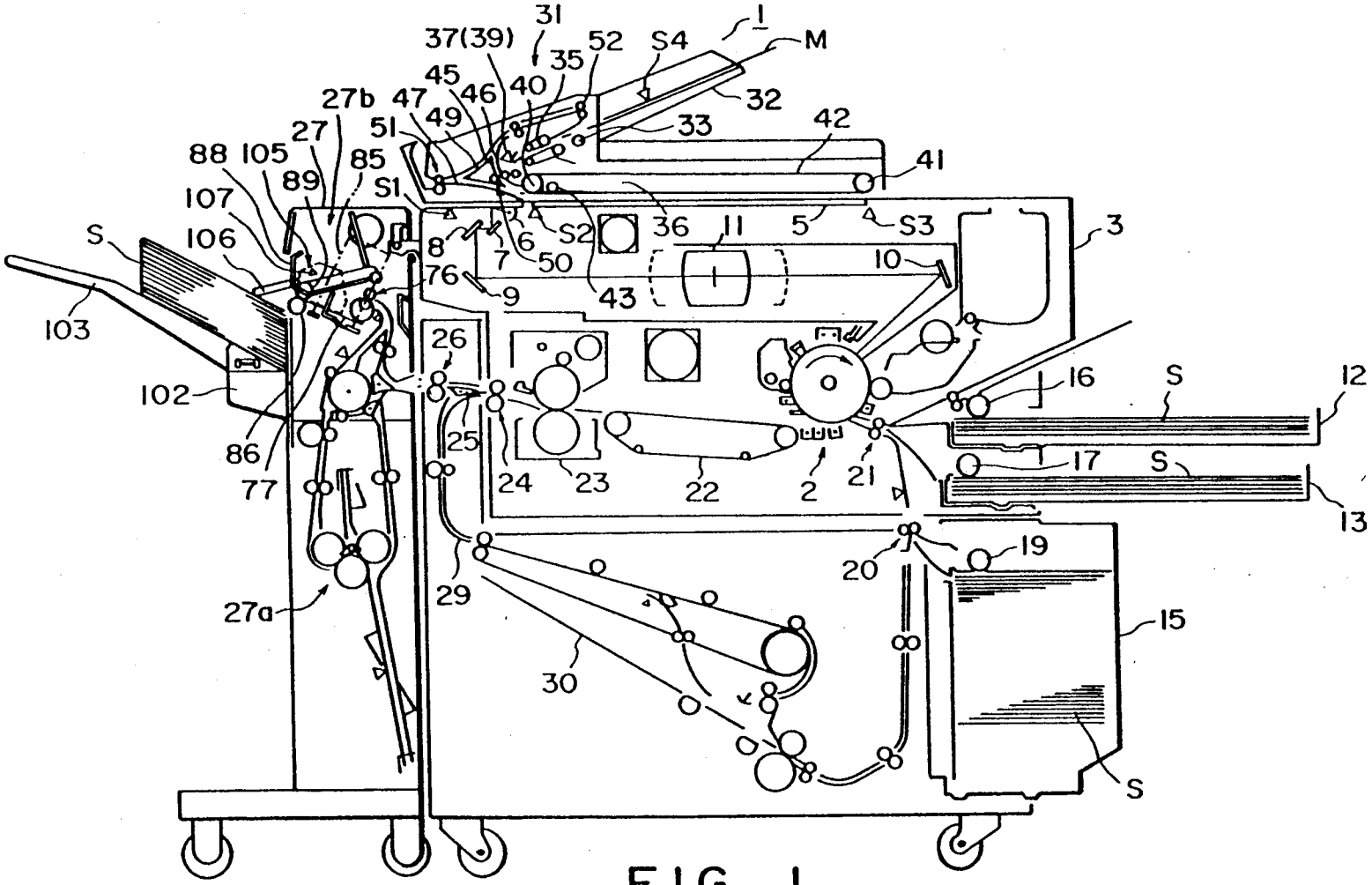
FIG. 1 is a front sectional view of a sheet finisher according to an embodiment of the present invention.

Referring to FIG. 1, a copying apparatus 1 includes a main assembly 3 containing therein a copying station 2. The main assembly 3 includes a platen 5, a light source 6, mirrors 7, 8, 9 and 10, a lens 11, two cassettes 12 and 13 for accommodating sheets S and a deck 15 for accommodating sheets. At an upper portion of each of the cassettes 12 and 13 and the deck 15, there is disposed a pick-up roller 16, 17 or 19. Downstream of the pick-up roller 19, there is a sheet conveying station 20, and downstream of the sheet conveying station 20 and the pick-up rollers 16 and 17, there is a pair of registration rollers 21. Downstream of the registration rollers 21, the copying station 2 is disposed. Downstream of the copying station 2, there are a conveying belt 22 and a fixing device 23. Downstream of the fixing device 23, there are a pair of sheet discharging rollers 24, a flapper 25 and a pair of discharging rollers 26. Downstream of the discharging rollers 26, there is a sheet post-processing apparatus or a finisher 27 adjacent to the main assembly of the copying apparatus. The sheet finisher 27 comprises a folding station **27*a* for two-folding the sheets S or for z-folding the sheets and a finisher station 27*b* for stacking or stapling the sheets S. A branch provided by the flapper 25 is connected to a refeeding passage 29, and the refeeding passage 29 is provided with an intermediate tray 30. Designated by references S1, S2 and S3** are sensors.

The main assembly 3 of the copying apparatus is provided with an automatic document feeder 31 at its upper portion, and the document feeder 31 is provided with an original or document tray 32 for stacking originals M. Adjacent to the tray 32, there is a document feeding roller 33 for feeding an original M on the tray 32. Downstream of the roller 33, there are a separation belt 35 rotatable in the counterclockwise direction and a conveyor belt 36 rotatable in the counterclockwise direction. Adjacent to the belt 36, there are sensors 37 and 39 for detecting the sizes of the originals M, which are laterally arranged on a line with respect to the conveyance direction of the original. Downstream of the sensors 37 and 39, a conveyor belt 42 is stretched around a driving roller 40 and a follower roller 41. Near an original discharging portion 43 at the left side of the belt 42, there is disposed a flapper 45. Around the flapper 45, there are conveyance passages 46, 47 and 49 which are selected by the flapper 45. In the conveyance passage 46, there is a pair of conveyor rollers 50; the conveyance passage 47 is provided with a pair of conveyor rollers 51; and the passage 49 is provided with a discharging roller 52. Designated by a reference S4 is a sensor for a circulation of a sheet.

Figure 2:
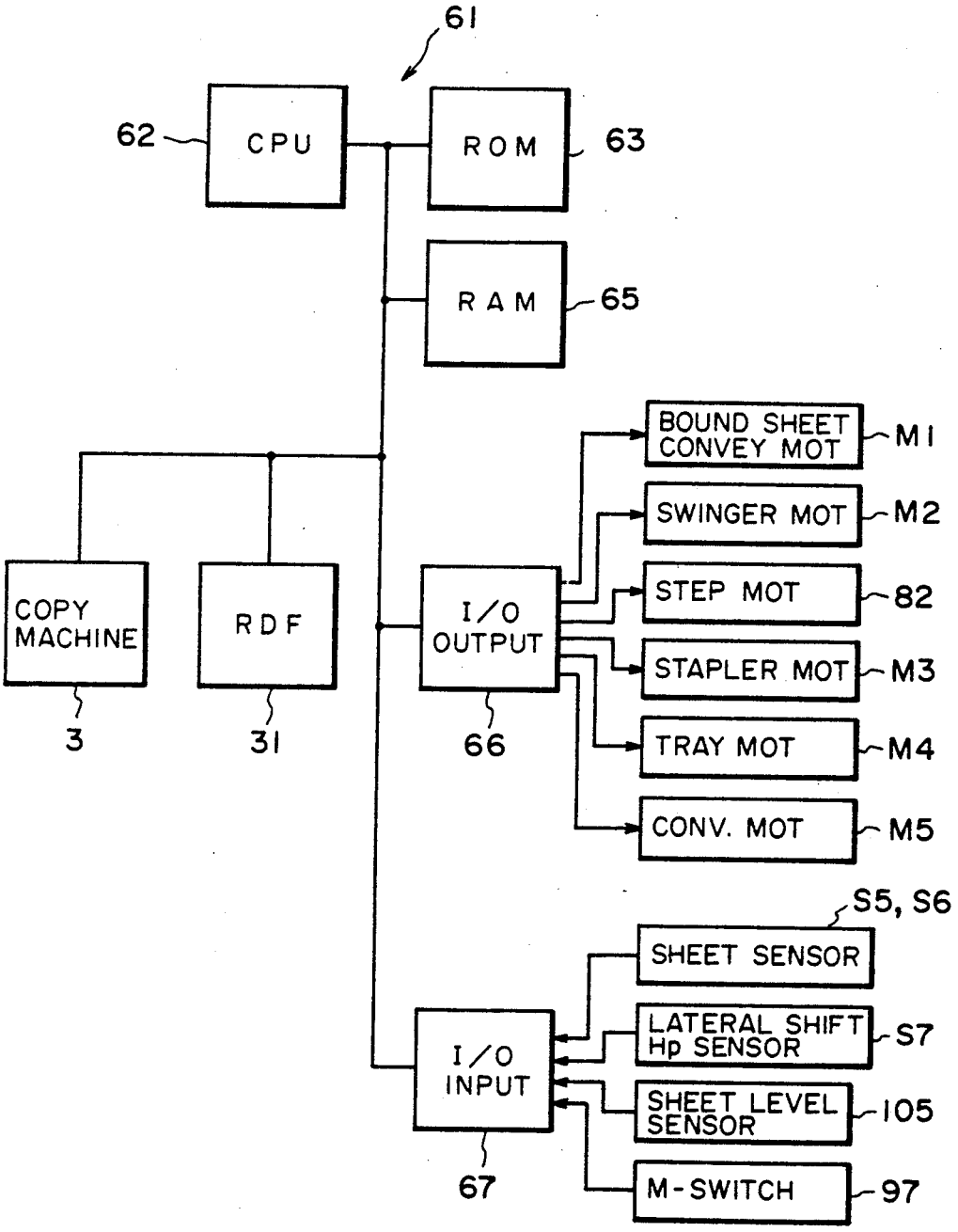
FIG. 2 is a block diagram of a control system for FIG. 1 apparatus.

As shown in FIG. 2, the sheet finisher apparatus 27 is provided with a controller 61. The controller 61 comprises a central processing unit (CPU) 62, a ROM 63 storing a controlling program for controlling the CPU 62, and a RAM 65 functioning as a main memory. The controller 61 is connected with an output interface 66 for supplying a control signal to the loads such as a main motor and an input interface 67 for receiving detection signals from various sensors. Other various loads and sensors of the main assembly 3 and the automatic document feeder 31 are similarly connected therewith through interfaces which are not shown. The output interface 66 is connected with a bound sheet conveying motor M1, a swinging motor M2, a stepping motor 82, a stapler motor M3, a tray up-and-down motor M4 and a conveying motor M5. On the other hand, the input interface 67 is connected with the sheet detecting sensors S5 and S6, a lateral shifting plate home position sensor S7, a sheet level sensor 105 and a microswitch 97.

Figure 3:
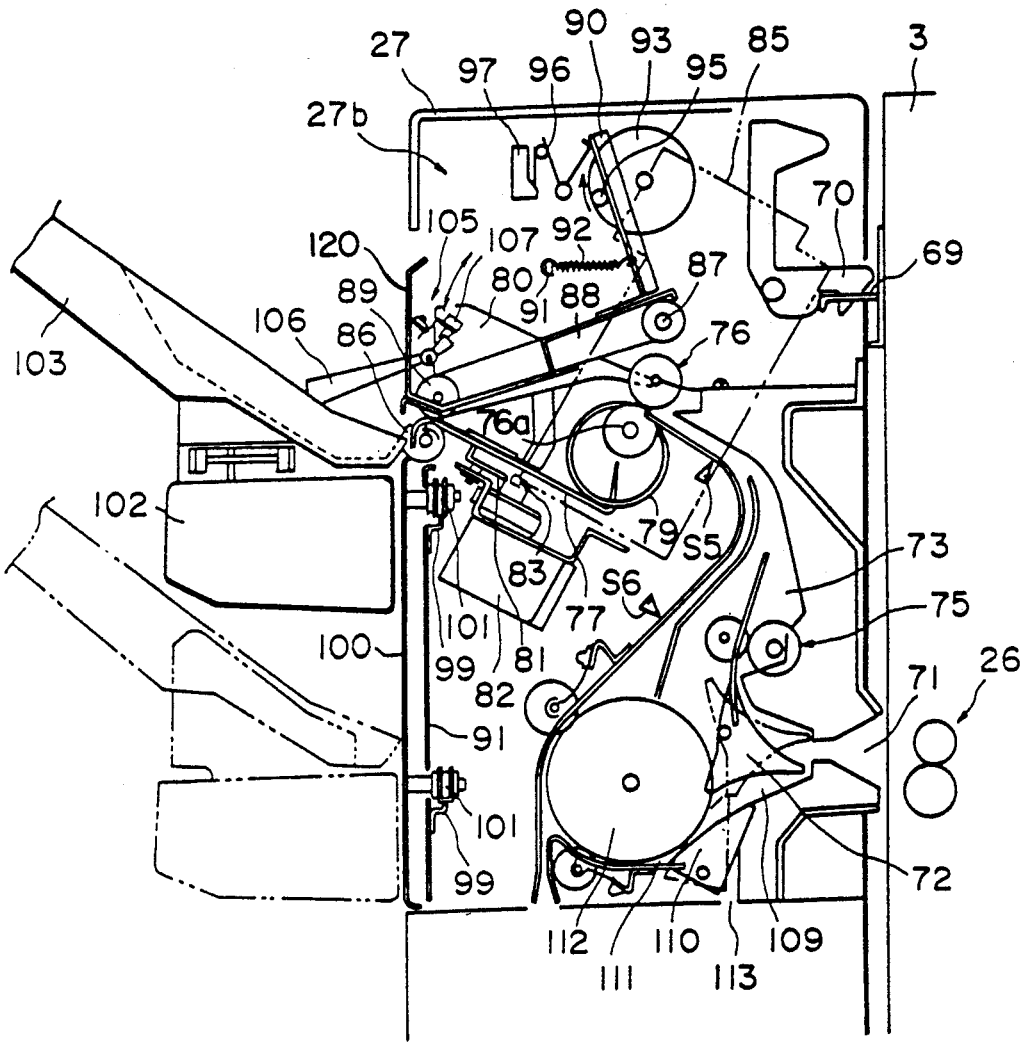
FIG. 3 is a front sectional view of a part of the apparatus of this embodiment.

As shown in FIG. 3, the sheet finisher apparatus 27 is equipped with a swingable hook 70 engageable with an engaging member 69 provided on a side of the main assembly 3 of the copying apparatus. By the engagement between the hook 70 and the engaging member 69, the sheet finisher apparatus 27 is correctly positioned relative to the main assembly. In a side of the apparatus 27, an inlet opening 71 is formed to receive the sheet S discharged by the pair of discharging rollers 26. Downstream of the inlet 71, a deflector 72 is disposed. Downstream of the deflector 72, a first conveyance passage 73 is formed. The passage 73 is provided with a pair of conveying rollers 75. Downstream of the first conveyance passage 73, a pair of discharging rollers 76 is disposed. Downstream of the rollers 76, a processing tray 77 is disposed. On the bottom of roller 76*a* of the pair of rollers 76, a part of a belt 79 is wound, and the lower portion of the belt 79 is contacted to a surface of the sheet processing tray 77. The tray 77 is provided with a movable lateral shifting plate 80 for aligning the sheets S in the lateral direction, and a positioning plate (not shown). The bottom portion of the lateral shifting plate 80 is formed into a rack 81 which is in meshing engagement with a pinion gear 83 driven by a stepping motor 82 disposed below the processing tray 77. Adjacent to the processing tray 77, there is a stapler 85 functioning to staple the sheet S stacked on the tray 77. Adjacent the front end of the tray 77, there is a discharging roller 86 to which a swingable roller 89 mounted on a corner of a swinging arm 88 swingably supported on a shaft 87 is contacted. A guide lever 90 is planted in the swingable arm 88. To the lever 90, a spring 92 is connected, and the other end of the spring 92 is fixed on a frame 91. By the spring, the swingable arm 88 is normally urged in the counterclockwise direction. Adjacent to the guide lever 90, a disk 93 rotatable by the swinging motor M2 is disposed A pin 95 is planted in the disk 93 and is engageable with the guide lever 90. Adjacent to the disk 93, a leaf spring 96 having an "L" shape as seen from the front is swingably supported, and adjacent to the spring 96, a microswitch 97 is disposed. The frame 91 is provided with a rail plate 99 extending horizontally. The rail plate 99 supports a rotatable roller 101 mounted on a hurdle guide 100. Therefore, the hurdle guide 100 is movable in a direction perpendicular to the sheet of the drawing. To the guide 100, a tray moving table 102 is supported for substantially vertical movement To the movable table 102, a stack tray 103 recessed at its base side and functioning to stack the sheets S is disposed. To a swingable guide 120, a sheet level sensor 105 is mounted to detect the level of the stack of the sheets S on the stack tray 103. The sensor 105 is constituted by a sensor lever 106 contactable to the sheets S stacked on the stack tray 103 and a photosensor 107.

On the other hand, a second conveying passage 109 is branched out by the deflector 72. To the terminal end of the passage 109, there is a deflector 110. Downstream of the deflector 110, a curved third passage 111 is formed. An inside guiding surface of the passage 111 is formed by a large roller 112. The conveying passage 111 communicates with the first passage 73. Branched out by the deflector 110 is a folding conveyance passage 113, downstream of which a folding station 27*a* is disposed. Designated by references S5 and S6 are sheet detection sensors for detecting the sheets.

Figure 4:
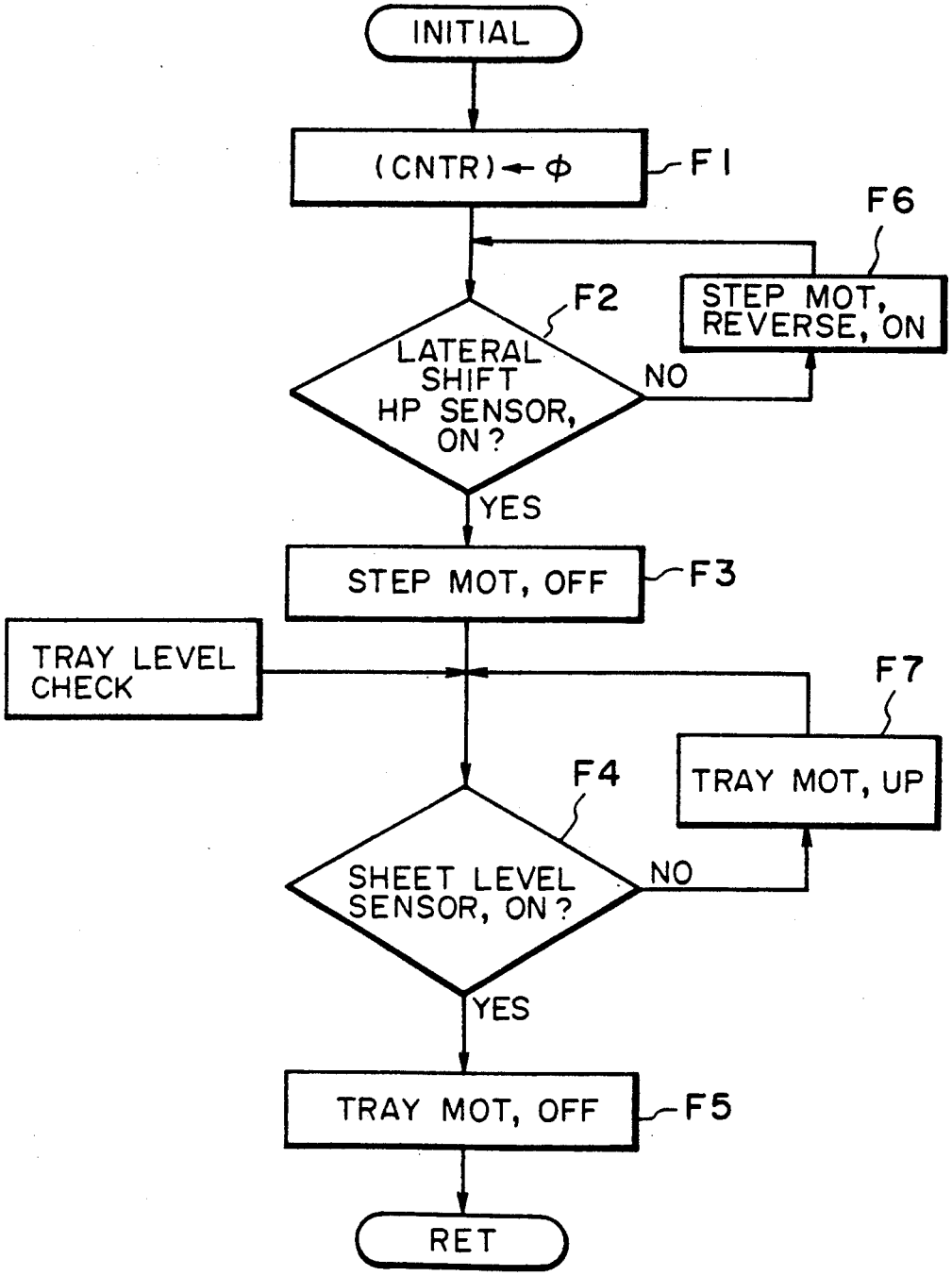
FIGS. 4 and 5 are flow charts illustrating the operation of the apparatus.
Figure 5A:
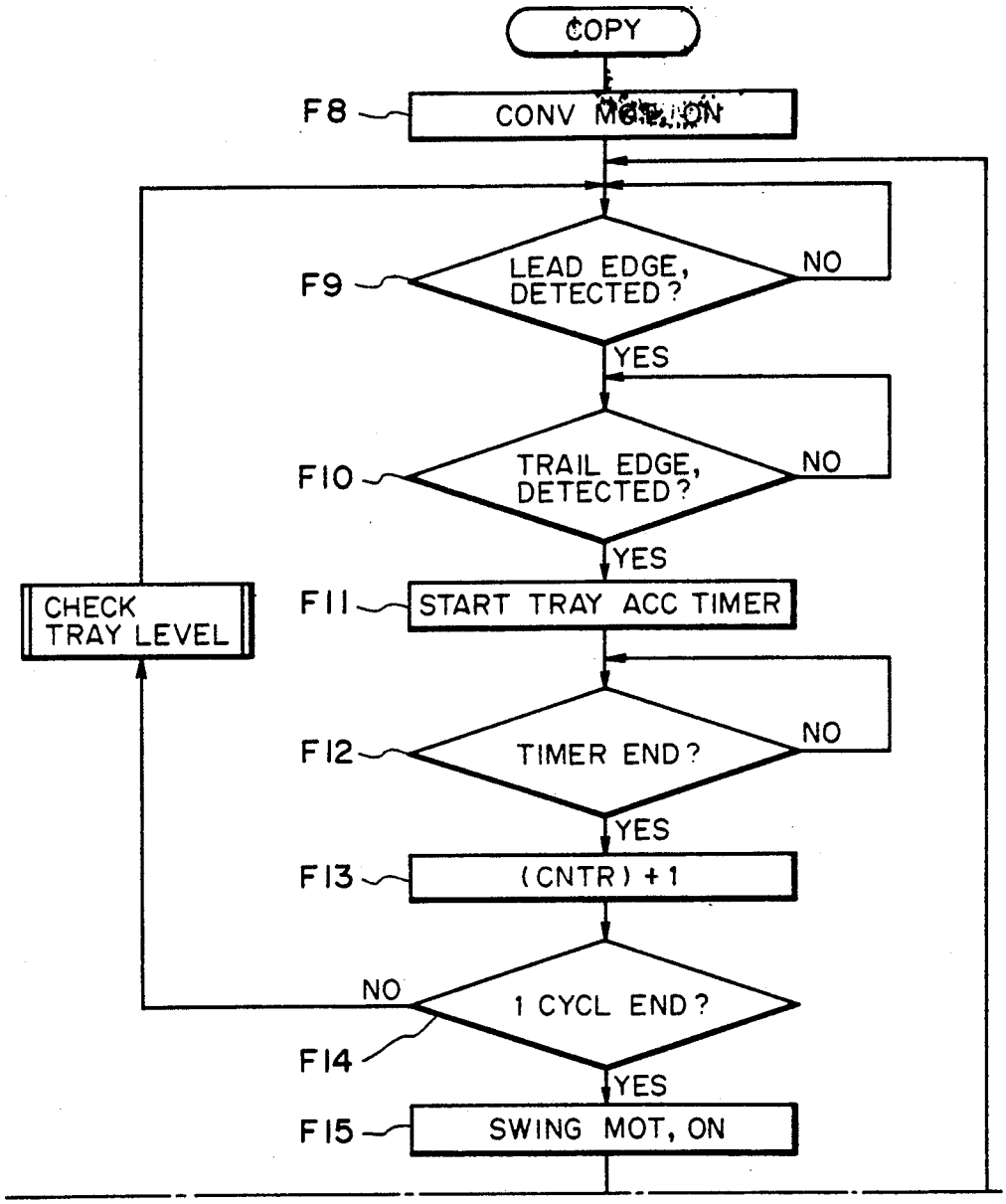
Figures 5, 5B:
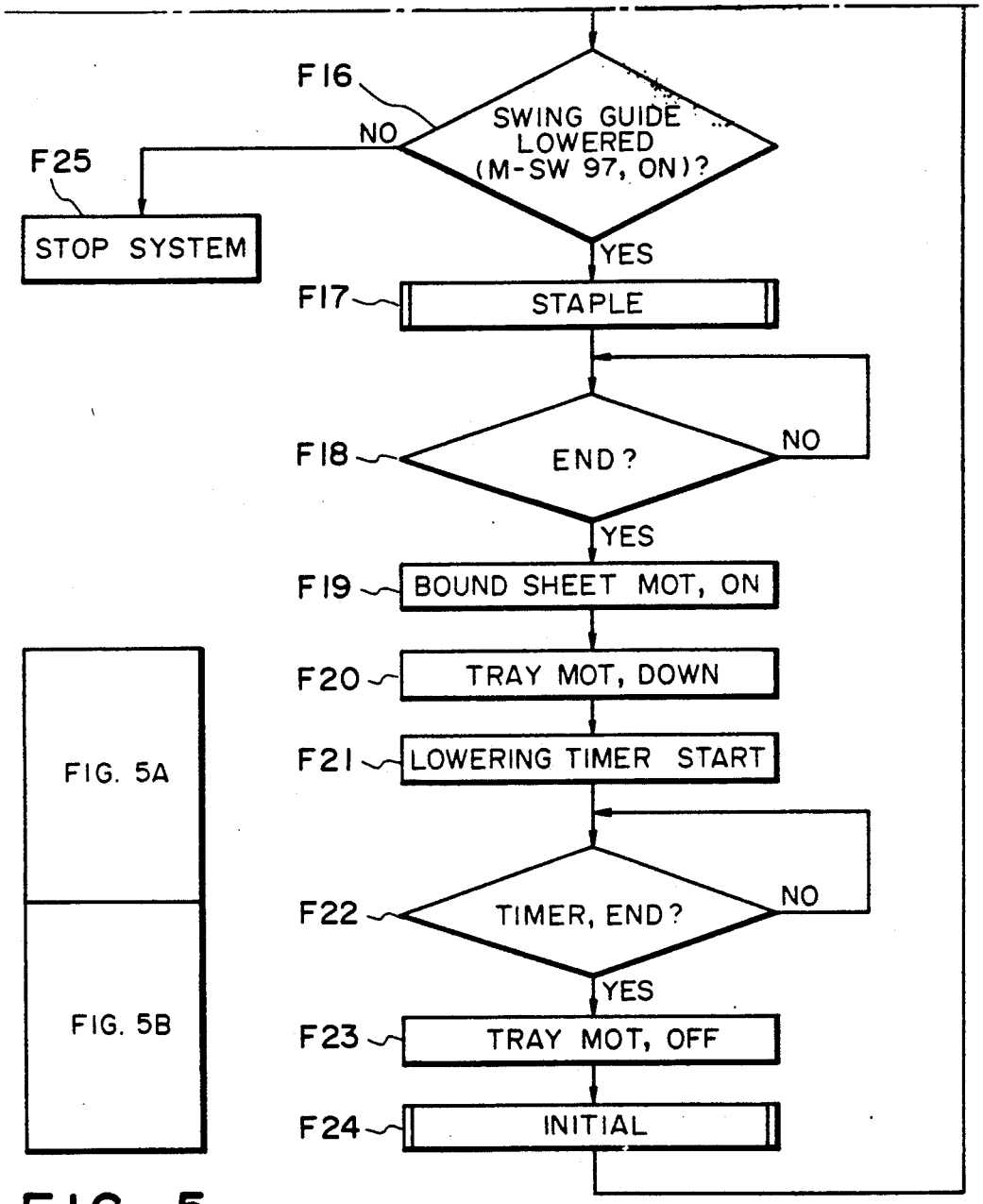

Referring to FIGS. 4 and 5 (flow charts), the operation of the apparatus will be described. When a main switch is closed, the CPU 62 resets an accommodation number counter (F1) and instructs the stepping motor 82 to rotate in the reverse direction to return the lateral shifting plate 80 to its home position. The CPU 62, then, discriminates on the basis of the signal from the home position sensor S7 whether or not the lateral shifting plate 80 is at its home position (F2). If so, the stepping motor 82 is stopped (F3). Further, the CPU 62 actuates the tray up and down motor M4, by which the stack tray 103 is brought into contact with the sensor lever 106 to swing the lever 106. Then, a discrimination is made as to whether or not the sheet level sensor 105 is actuated or not (F4). The CPU 62 stops the tray motor M4, by which the movement of the stack tray 103 is terminated (F5). Now, the tray 103 is prepared for accommodating the sheets S. If the discrimination at the step F2 is that the home position sensor S7 is not actuated, the stepping motor 82 continues to rotate in the reverse direction until the sensor S7 is actuated (F6) when the discrimination is that the sheet level sensor 105 is not actuated, the tray motor M4 is rotated for the upward movement until the sensor 105 is actuated (F7).

When the originals M are stacked on the original tray 32, and an unshown start key is actuated, an unshown motor is rotated so that the document feeding roller 33 is driven, and simultaneously, the separation belt 35 and the conveyor belt 36 are driven in the counterclockwise direction. The originals M stacked on the original tray 32 are fed by the document feeding roller 33, and are separated and fed one by one from the bottom of the stack of the originals by the separation belt 35 and the conveyor belt 36.

The original M is fed into between the platen 5 and the conveyor belt 42, and is conveyed and stopped at an original reference position on the platen by the conveyor belt 42. An image of the original M is read by the lamp 6, the mirrors 7, 8, 9 and 10 and the lens 11, so that an image is formed in the copying station 2. A sheet S is supplied from one of the cassettes 12 and 13 and the deck 15 selected by a selection switch, is fed to a sheet feeding roller 16, 17 or 19, and the sheet S is conveyed in synchronism with the image formed in the copying station 2 by a pair of registration rollers 21. On the sheet S, an image is formed in the copying station 2, and is conveyed to the image fixing device 23 by the conveyor belt 22. The sheet S is subjected to an image fixing operation in the fixing device 23. If the image formation mode is a simplex copy mode, the sheet is guided by the flapper 25 and is conveyed to the sheet finisher 27 by the discharging rollers 26. When a superimposing copy or duplex copy mode is selected, the sheet S is branched out and guided by the flapper 25 into the refeeding passage 29. After the sheet S is subjected to an additional image forming operation, it is conveyed into the sheet finisher 27 in the similar manner.

When the CPU 62 of the sheet finisher 27 receives the start signal from the copying apparatus 3, the conveying motor M5 is actuated to drive various rollers (F8).

Figure 6:
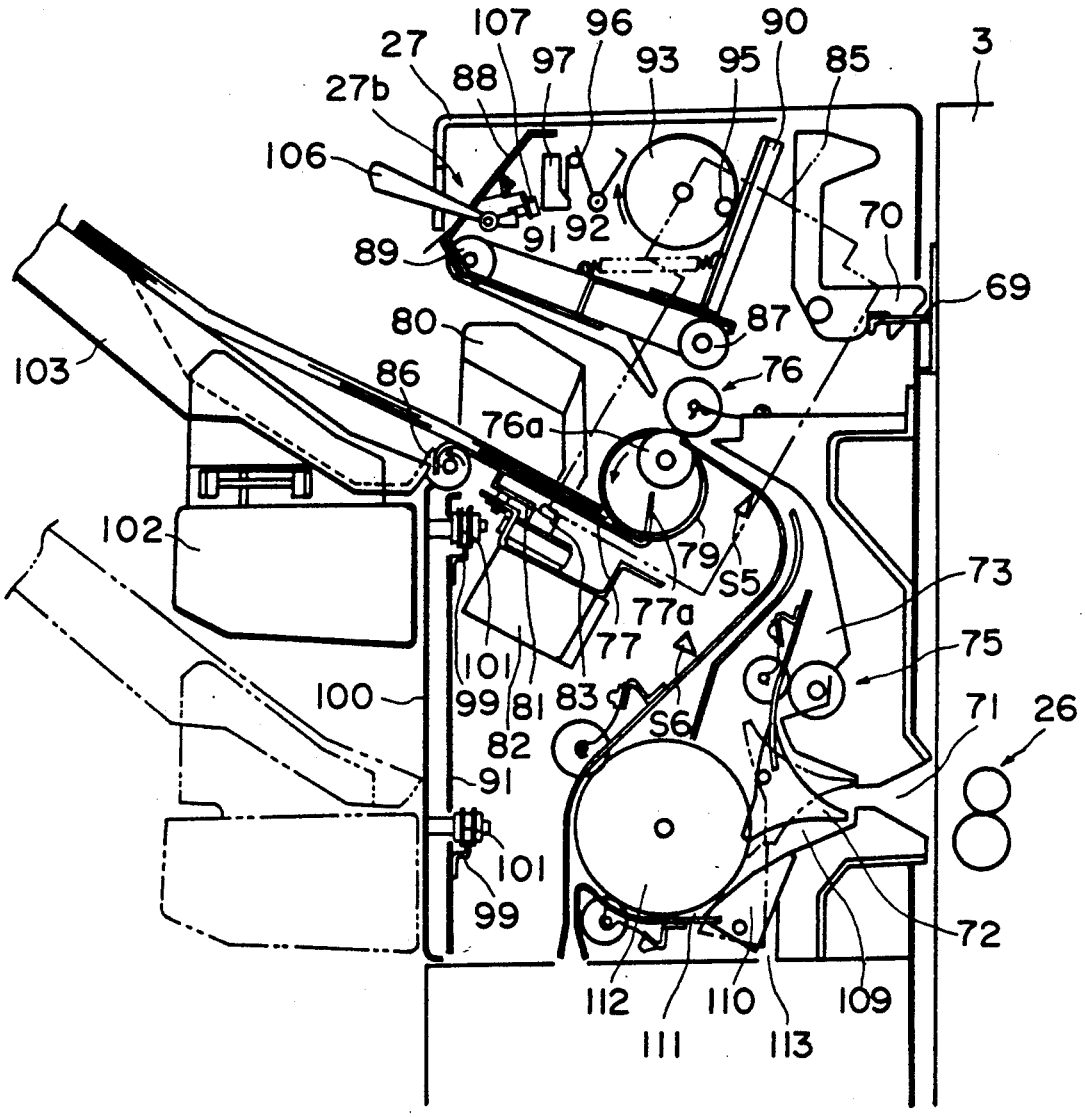
FIGS. 6, 7A, 7B, 7C, 7D and 8 are front sectional views illustrating the operation of the apparatus.
Figure 7C:
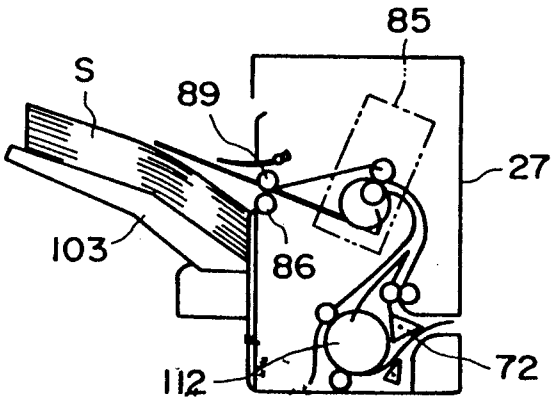
Figure 7D:
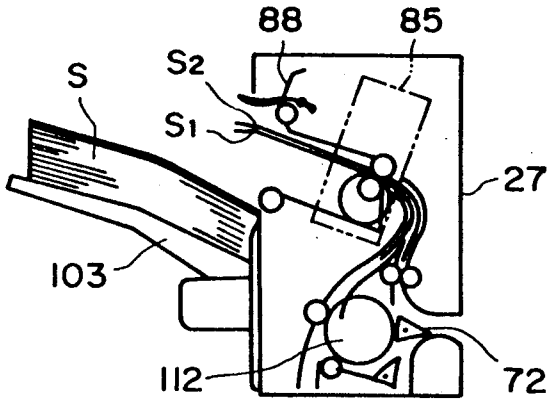
Figure 7A:
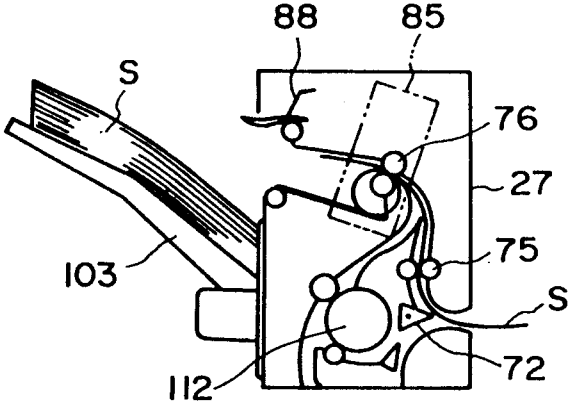
Figure 7B:
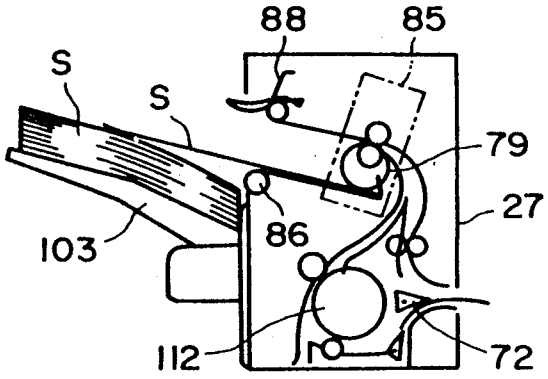
Figure 8:
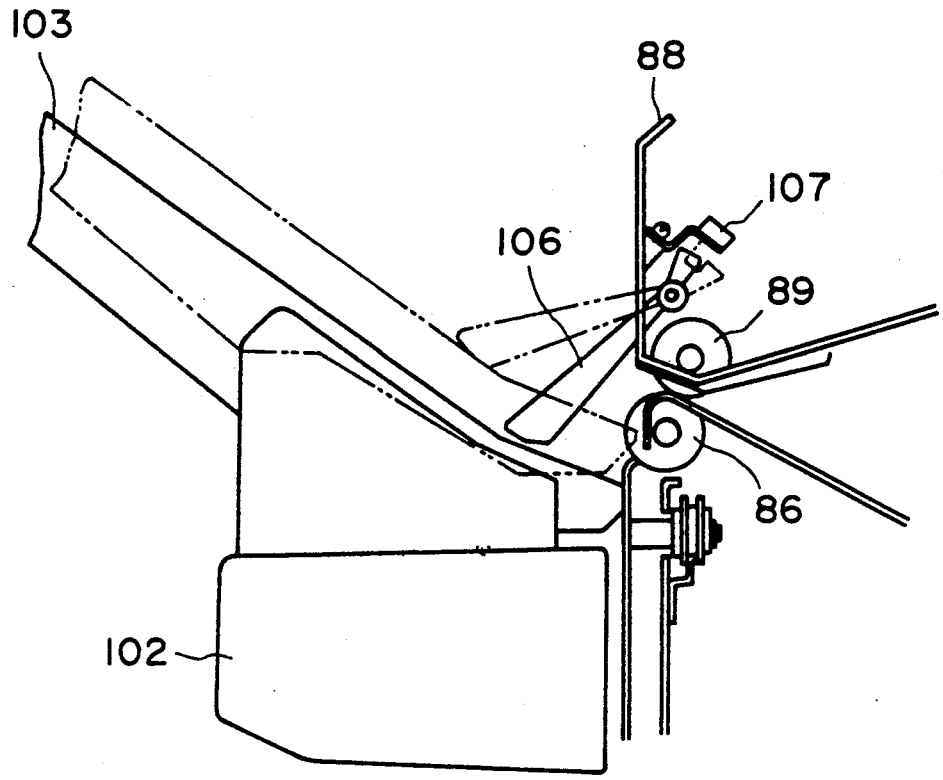

If a stapling mode is selected in the unshown operating panel of the copying apparatus 3, the CPU 62 rotates the disk 93 through a predetermined rotatable amount by the swinging motor M2, upon which the pin 95 integrally rotatable with the disk 93 swings the guide lever 90 in the clockwise direction (FIG. 6). By the swinging movement of the lever 90, the swingable guide 88 rotates in the clockwise direction about the shaft 87, by which the swingable roller 89 and the discharging roller 86 are separated. The sheet S discharged from the copying apparatus 3 is introduced through the inlet 71 and is detected either to the first passage 73 or the second passage 109 by the detector 72. For example, when the non-folding mode is selected, the sheet S is guided into the first passage 73, by which it is directed to the sheet discharge rollers 76 (FIG. 7A). At this time, the CPU 62 discriminates on the basis of the signal from the sheet detecting sensor S5 whether or not the sensor S5 detects the leading edge of the sheet S (F9). If so, it further discriminates whether or not the sensor S5 detects the trailing edge of the sheet S (F10). When it is discriminated that the sensor S5 detects the trailing edge of the sheet S, the CPU 62 starts a tray accommodating timer having a predetermined timer period (F11). The sheet S is conveyed by the sheet discharging rollers 76 so that it bridges between the processing tray 77 and the stack tray 103 (FIG. 7B). It is laterally aligned by being abutted to the positioning plate by the lateral shifting plate 80, and it is also aligned in the longitudinal direction by being abutted to the base side end of the processing tray 77 by the discharging roller 86 rotating in the clockwise direction only for the first sheet S and by the belt 79 rotating in the counterclockwise direction. When the timer period of the tray accommodating timer ends (F12), the CPU 62 increments the accommodating number counter (F13), and discriminates on the basis of the signal from the sensor S4 as to whether or not the originals M are circulated once, that is, whether or not one cycle of the copying operation is completed (F14). If the result of the discrimination is negative, the CPU 62 checks the height of the stack tray 103 in the similar manner as in the steps F4 and F5, and thereafter, the operations after the step F9 are performed. If the completion of one cycle of the copying process is discriminated, the CPU 62 actuates the swinging motor M2 to rotate the disk 93 in the clockwise direction (F15). By the rotation of the disk 93, the urging force to the guiding lever 90 through the pin 95 is removed, by which the lever 90 is urged in the counterclockwise detection by the spring 92. Then, the lever 90 is brought into contact with the leaf spring 96 to swing the spring 96 in the counterclockwise direction, by which the microswitch 97 is actuated, upon which the CPU 62 stops the swinging motor M2 (F16). At this time, by the swinging movement of the lever 90, the swingable guide 88 is swung in the counterclockwise direction integrally with the lever 90, so that the discharging roller 86 and the swingable roller 89 are contacted (FIG. 7C). Using an unshown sensor, the CPU 62 confirms the presence of the sheet S on the processing tray 77, and thereafter, it actuates the stapler 85 to staple the set of sheets S (F17). Upon completion of the stapling operation (F18), the CPU 62 actuates the motor M1 for conveying the stapled sheets (F19) to discharge the stapled sheets S onto the stack tray 103 by the discharging rollers 86 and the swingable rollers 89 (FIG. 7C). At this time, the stapled set of sheets S raises the sensor lever 106, by which the beam of the photosensor 107 is passed (FIG. 8).

During the stapling and discharging operations described above, the next first sheet S is guided into the third passage 111 by the deflector 72 and stays in the passage 111. Then, the set of sheets described is discharged, and the roller 86 and the roller 89 are separated. Thereafter, the above-described next sheet S1 is discharged on the processing tray 77 together with a second sheet S2 guided along the first passage 73 (FIG. 7D). The CPU 62 starts the tray up-and-down motor M4 to lower the stack tray 103 (F20), and starts a timer having a timer period corresponding to the amount of downward movement corresponding to the count of the accommodating number counter (F21). When the thickness of the sheet is 0.1 mm, for example, the timer period corresponds to 2 mm downward movement if the count of the counter is 10, and it corresponds to 3 mm downward movement if the count is 20. In this manner, it is set slightly larger than the thickness of the sheets. When the timer periods terminates (F22), the CPU 62 deactuates the tray up-and-down motor M4 (F23). At this time, the CPU 62 moves laterally the stack tray 103 and the hurdle guide 106 by an unshown driving means to off-set the set of sheets S stacked on the tray 103 to prevent the stapled portions from becoming thicker. The CPU 62 performs the initializing processes from the steps F1 to F5 (F24), and thereafter the operations F9 and et seqs. for the next job.

In the step F16, if the microswitch 97 is not actuated, that is, if there is a foreign matter (for example a book or hand or finger of the operator) on the processing tray 77, the CPU 62 stops the system (F25).

When the folding mode is selected, the sheet S received through the inlet 71 is directed by the deflector 72 to the deflector 110 by which it is guided to the folding station **27*a* through the force passage 113. In the folding station 27*a*, it is two-folded or z-folded. The folded sheet S is conveyed to the third passage 111 by the large roller 112, and the operation of step F8** and the subsequent operations are carried out.

When the non-stapling mode is selected, the swingable roller 89 is disposed at the position where it contacts to the discharging roller 86 (FIG. 3), the sheet S received by the inlet 71 is directed to the first passage 73 by the deflector 72, and is directly discharged onto the stack tray 103 by the discharging rollers 76, the discharging rollers 86 and the swingable roller 89.

Figure 9:
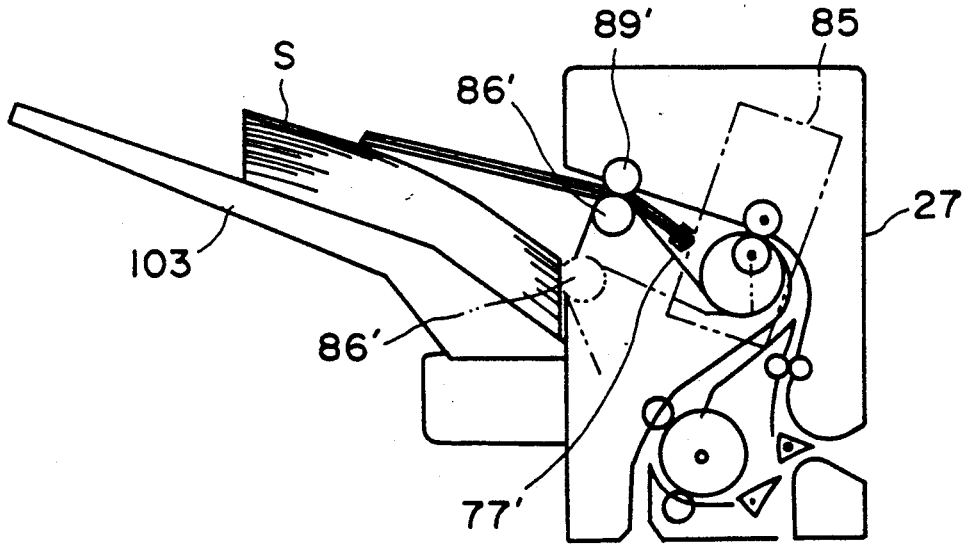
FIG. 9 is a front sectional view of an apparatus according to another embodiment of the present invention.

In the foregoing embodiment, the swingable roller 89 is swingably supported. However, the invention is not limited to this embodiment, and as shown in FIG. 9, the processing tray 77' is made swingable. In FIG. 9, the solid lines indicate the state wherein the roller 86 is raised, and the stapled sheets are discharged in cooperation with the roller 89'.

As a means for discharging the stapled sheets to the tray 103, an alignment means 77*a* shown in FIG. 6 is usable. In this case, the alignment means 77*a* is mounted for sliding movement relative to the tray 77, and the alignment means 77*a* is slid leftwardly in FIG. 6. By doing so, the stapling side of the set of the sheets is pushed to move. When the set of sheets is accommodated in the tray 103, the alignment means 77*a* is reset. This embodiment is the same as the embodiment of FIG. 1 in other respects.

Figure 10:
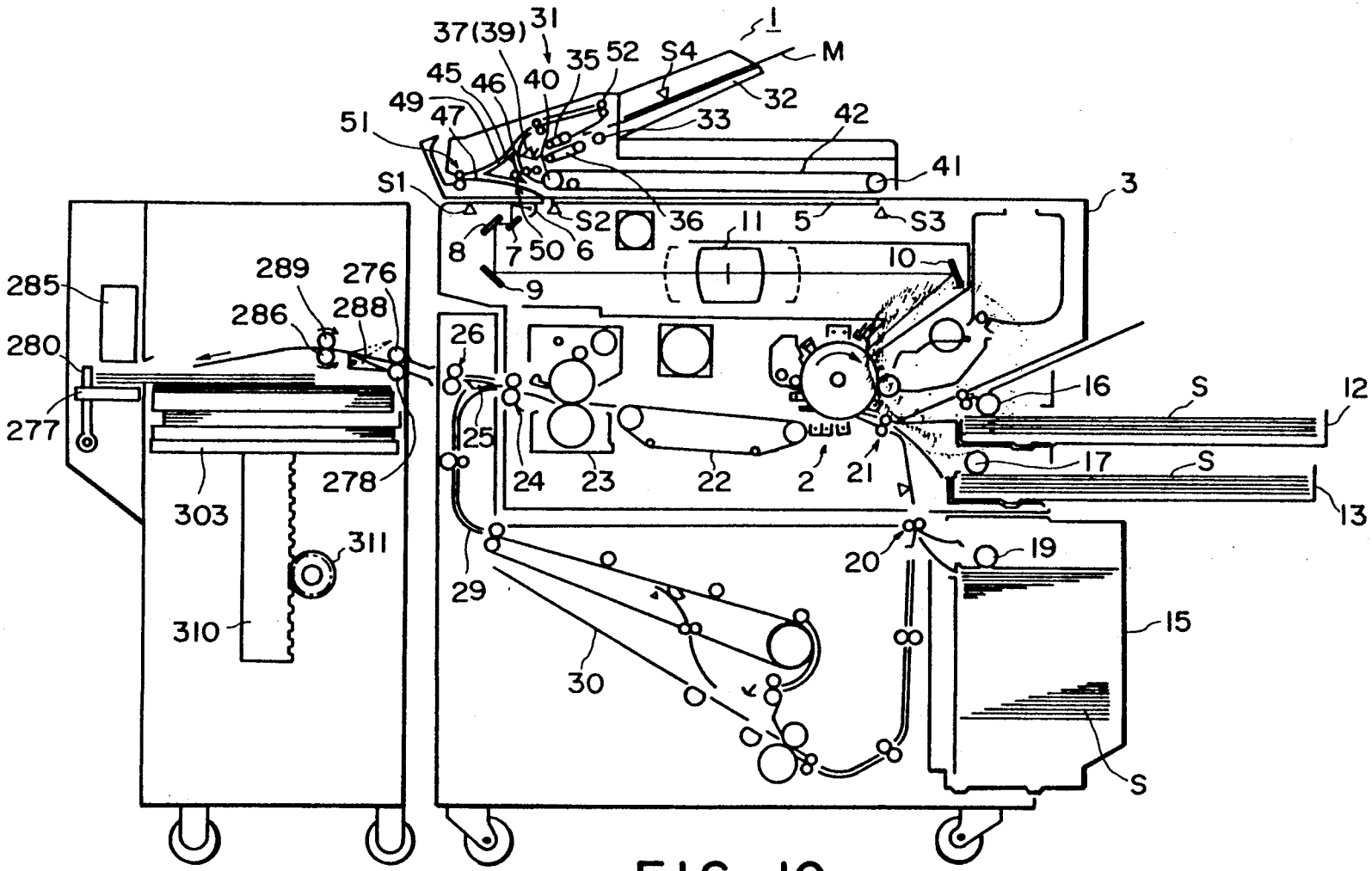
FIG. 10 is a front sectional view of a sheet finisher according to another embodiment of the present invention.

Referring to FIG. 10, a further embodiment will be described. In the stapling mode, the flapper 288 takes the position indicated by the solid lines, and therefore, the sheet is directed to the processing tray 277 through guiding rollers 276, 278, 286 and 289. The sheet is accommodated bridging between the processing tray 277 and the accommodating tray 303. When a predetermined number of sheets are stacked, the stapler 285 is operated to staple the sheets. Thereafter, an ejector 280 rotates in the clockwise direction to push the set of sheets to the accommodating tray 303. In the non-stapling mode, the flapper 288 takes the position indicated by the chain lines, and the sheet is discharged to the accommodating tray 303 through the guiding rollers 276 and 278. The accommodating tray 303 is movable up and down by the mechanism of rack 310 and a pinion 311.

While the invention has been described with reference to the structures disclosed herein, it is not confined to the details set forth and this application is intended to cover such modifications or changes as may come within the purposes of the improvements or the scope of the following claims.

What is claimed is:

1. A sheet post-processing apparatus, comprising:

a processing tray for stacking sheet materials discharged;

a stack tray, movable substantially vertically for accommodating sheet materials discharged;

first discharging means for discharging, in a processing mode, the sheet materials so that the sheet materials are bridged between said processing tray and said stack tray, and for discharging, in a non-processing mode, the sheet materials so that they are stacked on said stack tray;

processing means for processing the sheet materials stacked on said processing tray; and second discharging means for discharging from said processing tray the sheet materials processed by said processing means when a processing mode is selected to said stack tray, wherein said first discharging means includes a first discharging member for discharging the sheet materials to said processing tray, and a second discharging member for discharging the sheet materials to said stack tray, said second discharging member is movable between its operative position and non-operative position.

2. An apparatus according to claim 1, wherein said first discharging means includes a first rotatable member for directing the sheet materials to said processing tray and a second rotatable member for directing the sheet materials to said stack tray.

3. An apparatus according to claim 2, wherein said processing tray and stack tray are inclined upwardly toward the downstream direction with respect to a movement direction of the sheet materials, and wherein said first rotatable member is disposed upstream of said processing tray, and said second rotatable member is disposed downstream of said processing tray so as to direct the sheet materials to said stack tray, skipping said processing tray.

4. An apparatus according to claim 3, wherein said second rotatable member is non-operable in the processing mode, and is made operable in the non-processing mode.

5. An apparatus according to claim 4, wherein said second rotatable member includes a pair of rollers, which are separated in the processing mode, and which contact each other to convey the sheet material in the non-processing mode.

6. An apparatus according to claim 1, wherein said first discharging means includes a first discharging member for discharging the sheet materials to said processing tray, and a second discharging member for discharging the sheet materials to said stack tray, said second discharging member being movable between an operative position an a non-operative position, said apparatus further comprising means for detecting a position of said first discharging member, and control means, responsive to a signal from said detecting means, for allowing operation of said stack tray when said first discharging member is at its non-operative position.

7. An apparatus according to claim 6, wherein said first discharging member includes a pair of rollers which can assume a first position wherein they are separated, and a second position wherein they contact each other.

8. An apparatus according to claim 7, further comprising driving means for controlling separation and contact between said rollers, and control means, responsive to selection of the processing mode, for controlling said driving means to separate said rollers.

9. An apparatus according to claim 1, wherein said second discharging means is a part of said first discharging means.

10. An apparatus according to claim 1, wherein said second discharging means functions to push out the sheet materials.

11. An apparatus according to claim 9, wherein said first discharging means includes a pair of rollers which are contactable and separable relative to each other, wherein they are separated in the processing mode, and contact during the sheet discharging to convey the sheet materials.

12. An apparatus according to claim 10, wherein said pushing means functions also as aligning means for aligning edges of the sheet materials when they are accommodated in said processing tray.

13. An apparatus according to claim 1, wherein said second discharging member confines the sheet materials by processing it when the process means is in operation.

14. An apparatus according to claim 13, wherein said second discharging member discharges the sheet material to said stack tray after operation of the processing means.

15. An apparatus according to claim 13, wherein said second discharging member closes an opening communicating with said processing means, when the sheet material is pressed.

16. A sheet post-processing apparatus, comprising:

a processing tray for stacking sheet materials discharged, said processing tray being inclined upwardly toward the downstream direction with respect to a movement direction of the sheet materials to impart returning movement to the discharged sheet materials;

a stack tray, movable substantially vertically, for accommodating sheet materials discharged, wherein said stack tray is disposed downstream of said processing tray;

first discharging means for discharging, in a stapling mode, the sheet materials so that the sheet materials are bridged between said processing tray and said stack tray, and for discharging, in a non-stapling mode, the sheet materials so that they are stacked on said stack tray;

stapling means for stapling the sheet materials stacked on said processing tray; and second discharging means for discharging from said processing tray the sheet materials stapled by said stapling means when a processing mode is selected to said stack tray, wherein said first discharging means includes a first pair of rotatable members upstream of said processing tray and a second pair of rotatable members separable from and contactable with each other.

17. An image forming apparatus, comprising:

image forming means for forming an image;

a processing tray for stacking sheet materials discharged after image formation thereon by said image forming means;

a stack tray, movable substantially vertically, for accommodating sheet materials discharged;

first discharging means for discharging, in a processing mode, the sheet materials so that the sheet materials are bridged between said processing tray and said stack tray, and for discharging, in a non-processing mode, the sheet materials so that they are stacked on said stack tray;

processing means for processing the sheet materials stacked on said processing tray;

second discharging means for discharging from said processing tray the sheet materials processed by said processing means when a processing mode is selected to said stack tray, wherein said first discharging means includes a first discharging member for discharging the sheet materials to said processing tray, and a second discharging member for discharging the sheet materials to said stack tray, said second discharging member being movable between an operative position and a non-operative position.

18. An image forming apparatus, comprising:

image forming means for forming an image;

processing tray for stacking sheet materials discharged after image formation thereon by said image forming means, said processing tray being inclined upwardly toward the downstream direction with respect to a movement direction of the sheet materials to impart returning movement to the discharged sheet materials;

a stack tray, movable substantially vertically, for accommodating sheet materials discharged, wherein said stack tray is disposed downstream of said processing tray;

first discharging means for discharging, in a stapling mode, the sheet materials so that the sheet materials are bridged between said processing tray and said stack tray, and for discharging, in a non-stapling mode, the sheet materials so that they are stacked on said stack tray;

stapling means for stapling the sheet materials stacked on said processing tray; and second discharging means for discharging from said processing tray the sheet materials stapled by said stapling means when a processing mode is selected to said stack tray;

wherein said first discharging means includes a first pair of rotatable members upstream of said processing tray and a second pair of rotatable members separable from and contactable with each other.

* * * * *

UNITED STATES PATENT AND TRADEMARK OFFICE

CERTIFICATE OF CORRECTION

PATENT NO. : 5,021,837

DATED : June 4, 1991

INVENTOR(S) : Nobutaka Uto et al.

It is certified that error appears in the above-identified patent and that said Letters Patent is hereby corrected as shown below:

On the title page, Item [54] and Col.1, line 1

"APPARATUS DISCHARGED SHEET STACKING" should read --DISCHARGED SHEET STACKING APPARATUS--.

COLUMN 1:

Line 1, "APPARATUS DISCHARGED SHEET STACKING" should read --DISCHARGED SHEET STACKING APPARATUS--.

COLUMN 3:

Line 61, "disposed" should read --disposed.--.

COLUMN 4:

Line 4, "ment" should read --ment.--.

UNITED STATES PATENT AND TRADEMARK OFFICE

CERTIFICATE OF CORRECTION

PATENT NO. : 5,021,837

DATED : June 4, 1991

INVENTOR(S) : Nobutaka Uto et al.

It is certified that error appears in the above-identified patent and that said Letters Patent is hereby corrected as shown below:

COLUMN 8:

Line 20, "an" should read --and--; and

Line 47, "contact" should read --contact each other--.

Signed and Sealed this

Thirtieth Day of March, 1993

*Attest:*

STEPHEN G. KUNIN

*Attesting Officer*

*Acting Commissioner of Patents and Trademarks*